US008733301B2

(12) United States Patent
Sato et al.

(10) Patent No.: US 8,733,301 B2
(45) Date of Patent: May 27, 2014

(54) COVER STRUCTURE OF GENERAL-PURPOSE LIQUID-COOLED ENGINE

(75) Inventors: Yoshikazu Sato, Wako (JP); Takashi Ito, Wako (JP); Keita Ito, Wako (JP); Toru Kawai, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 118 days.

(21) Appl. No.: 13/194,631

(22) Filed: Jul. 29, 2011

(65) Prior Publication Data

US 2012/0067305 A1 Mar. 22, 2012

(30) Foreign Application Priority Data

Sep. 16, 2010 (JP) ..... 2010-208529
Sep. 16, 2010 (JP) ..... 2010-208589

(51) Int. Cl.
*F01P 1/02* (2006.01)

(52) U.S. Cl.
USPC ..... 123/41.7; 290/1 A; 181/204; 180/297; 123/339.23

(58) Field of Classification Search
None
See application file for complete search history.

(56) References Cited

U.S. PATENT DOCUMENTS 4,862,981 A * 9/1989 Fujikawa et al. ..... 180/68.4
5,660,245 A * 8/1997 Marier et al. ..... 180/190

FOREIGN PATENT DOCUMENTS

EP 0567037 A1 * 10/1993
JP 10-148134 A 6/1998

* cited by examiner

*Primary Examiner* — Rinaldi Rada
*Assistant Examiner* — Ruben Picon-Feliciano
(74) *Attorney, Agent, or Firm* — Westerman, Hattori, Daniels & Adrian, LLP

(57) ABSTRACT

A general-purpose liquid-cooled engine delivers a coolant cooling an engine body to a radiator and delivers a cooling air to the radiator by use of a cooling fan to cool the coolant. A cover structure of the general-purpose liquid-cooled engine covers the engine body and the radiator. An engine cover is configured so as to allow the cooling air to be delivered to the radiator. A muffler cover covers a muffler disposed adjacent to an external surface of the engine cover. An exterior cover covers an entire engine including the engine cover and the muffler cover.

3 Claims, 11 Drawing Sheets

18
62
14
22
46
22a
38
22c
37
86
22b
83
84
88
36a
36
82
81
85
48
71a
77a(77b)
77
35
34
32
74a
41
76
54
74b
31
54
49
33
42
74
12
21
74a
16
78a
(78b)
78
43
55
47
71
72
52

COVER STRUCTURE OF GENERAL-PURPOSE LIQUID-COOLED ENGINE

FIELD OF THE INVENTION

The present invention relates to a cover structure of a general-purpose liquid-cooled engine for delivering a coolant having cooled an engine body, to a radiator to cool the coolant and circulating the cooled coolant to the engine body.

BACKGROUND OF THE INVENTION

A general purpose engine of liquid-cooled type is used for example as a drive source for a power generator, a working machine, etc. Hereinafter, the general-purpose engine of liquid-cooled type, is referred to as "general-purpose liquid-cooled engine". In the general-purpose liquid-cooled engine, by way of example, a cylinder block and a cylinder head are integrally formed and a cooling fan is disposed at the end of a crankshaft, with a carburetor and a muffler fitted to the side wall of the cylinder block.

A known general-purpose liquid-cooled engine is disclosed in e.g., Japanese Patent Application Laid-Open Publication No. H10-148134 (JP H10-148134 A) in which an engine cover collectively covers the entire engine including the cylinder block, the cylinder head, the cooling fan, the carburetor, and the muffler.

According to the general-purpose liquid-cooled engine disclosed in JP H10-148134 A, noise attributable to the engine is suppressed by collectively covering the entire engine by the engine cover.

Ordinarily, in order to enhance the noise-proof effect of the engine, it is desirable to suppress a large noise arising from a combustion chamber, the muffler, etc., among the structural parts of the engine.

In the engine disclosed in JP H10-148134 A, however, the entire engine including the cylinder block, the cylinder head, the cooling fan, carburetor, and the muffler is collectively covered by the engine cover. It is therefore difficult to properly cover the parts such, as the combustion chamber and the muffler generating a relatively high level of noise and to secure a sufficient noise-proof effect.

A known general-purpose engine of air-cooled type is disclosed in e.g., Japanese Patent Application Laid-Open Publication No. 2010-7599 (JP 2010-7599 A) in which to secure sufficient cooling properties, a cooling air is fed to the entire engine collectively covered by a cover. In this general-purpose engine, by collectively covering the entire engine by the cover, the cooling air fed into the interior of the cover can be delivered to the entire engine (especially, e.g., the cylinder block, the muffler, etc). As a result, the cylinder block, the muffler, etc. can be cooled by the cooling air delivered.

It is preferred for the above general-purpose liquid-cooled engine as well to be configured such that the entire engine is collectively covered by the cover in the same manner as the general-purpose engine of air-cooled type.

To collectively cover the general-purpose liquid-cooled engine by the cover, however, there is a need to effectively cool the coolant by feeding a cooling air to the radiator for liquid cooling, which necessitates a scheme different from that of the air-cooled general-purpose engine.

SUMMARY OF THE INVENTION

It is therefore an object of the present invention to provide a cover structure of a general-purpose liquid-cooled engine ensuring a satisfactory noise-proof effect and capable of effective cooling.

According to an aspect of the present invention, there is provided a cover structure of a general-purpose liquid-cooled engine in which a coolant cooling an engine body is delivered to a radiator, the radiator being fed with a cooling air by a cooling fan to cool the coolant, the cover structure comprising an engine cover configured to cover the engine body and the radiator in such a manner as to allow the cooling air to be delivered to the radiator, a muffler cover configured to cover a muffler disposed adjacent to an external surface of the engine cover, and an exterior cover configured to cover an entire engine including the engine cover and the muffler cover.

In this manner, the configuration of the present invention is such that only the engine body and the radiator are covered by the engine cover and that only the muffler is covered with the muffler cover. Consequently, the dimensions of the engine cover and the muffler cover can be reduced as compared with the case where the entire engine is collectively covered by the engine cover as in the prior art. Reduction in the dimensions of the engine cover and the muffler cover enables the engine cover and the muffler cover to individually and effectively cover the parts generating a relatively high level of noise such as the combustion chamber and the muffler. By effectively covering the parts generating a relatively high level of noise such as the combustion chamber and the muffler in this manner, a satisfactory noise-proof effect can be ensured.

Furthermore, the configuration of the present invention is such that the entire engine including the engine cover and the muffler cover is covered by the exterior cover. By covering the entire engine by the exterior cover, it is possible to ensure a more preferred noise-proof effect and to improve the external appearance of the general-purpose liquid-cooled engine.

Preferably, the cover structure covers the cooling fan disposed adjacent to the external surface of the engine cover, the cover structure further comprising a recoil cover in which a recoil starter for startup of the engine is incorporated.

The general-purpose engine is usually provided with a recoil starter in the vicinity of the cooling fan. Therefore, the configuration is employed in which the recoil cover of the recoil starter is used also as a cover of the cooling fan. It is thus possible to remove the dedicated cover for the cooling fan and to reduce the number of components.

In addition, the configuration of the present invention is such that only the cooling fan and the recoil starter of the engine body are covered by the recoil cover. Thus, the dimensions of the recoil cover can be reduced as compared with the case where the entire engine is collectively covered by the engine cover as in the prior art. Reduction in the dimensions of the recoil cover enables the recoil cover to individually and effectively cover the parts generating a relatively high level of noise such as the cooling fan. By effectively covering the parts generating a relatively high level of noise such as the cooling fan in this manner, a more preferred noise-proof effect can be assured.

Preferably, the muffler cover includes a communication port disposed so as to allow an interior of the muffler cover to communicate with an interior of the recoil cover, and, a louver disposed on the muffler cover to allow a cooling air fed through the communication port into the muffler cover to be discharged to an exterior of the muffler cover. This enables the cooling air fed into the muffler cover to be delivered along the wall surface of the muffler to the louver. As a result, heat of the exhaust gas flowing through the interior of the muffler is absorbed by the cooling air so that the temperature of the muffler can fall.

Desirably, the engine cover has a cooling air inlet for taking in the cooling air thereinto, the cooling air inlet supporting the radiator thereon, the recoil cover communicates with the cooling air inlet, and the muffler cover covers the muffler, the muffler communicating with an interior of the recoil cover so as to allow the cooling air fed from the cooling fan to be delivered thereinto, the muffler disposed on the outside of the engine cover. Therefore, driving (turning) the cooling fan enables cooling an to be satisfactorily delivered to the cooling air inlet (i.e., the radiator). In consequence, a coolant in the radiator can properly be cooled by the cooling air and the general-purpose liquid-cooled engine can effectively be cooled by the coolant thus cooled. Furthermore, the muffler is covered by the muffler cover so that the cooling air fed from the cooling fan can be delivered to the interior of the muffler cover. As a result, heat of the exhaust gas flowing through the interior of the muffler is absorbed by the cooling air fed into the muffler so that the temperature of the muffler can fall.

In a preferred form, an exhaust gas discharged from the muffler and the cooling air fed from the cooling fan are mixed together in an interior of the muffler cover, and a mixture of the exhaust gas and the cooling air is discharged from the, interior of the muffler cover toward an exterior thereof. By mixing the exhaust gas and the cooling air in this manner, the temperature of the exhaust gas can fall more. This enables the exhaust gas discharged to the exterior of the muffler cover to have a lower temperature.

BRIEF DESCRIPTION OF THE DRAWINGS

Certain preferred embodiments of the present invention will now be described in detail, by way of example only, with reference to the accompanying drawings, in which.

DETAILED DESCRIPTION OF THE PREFERRED EMBODIMENTS (First Embodiment)

Figure 1:
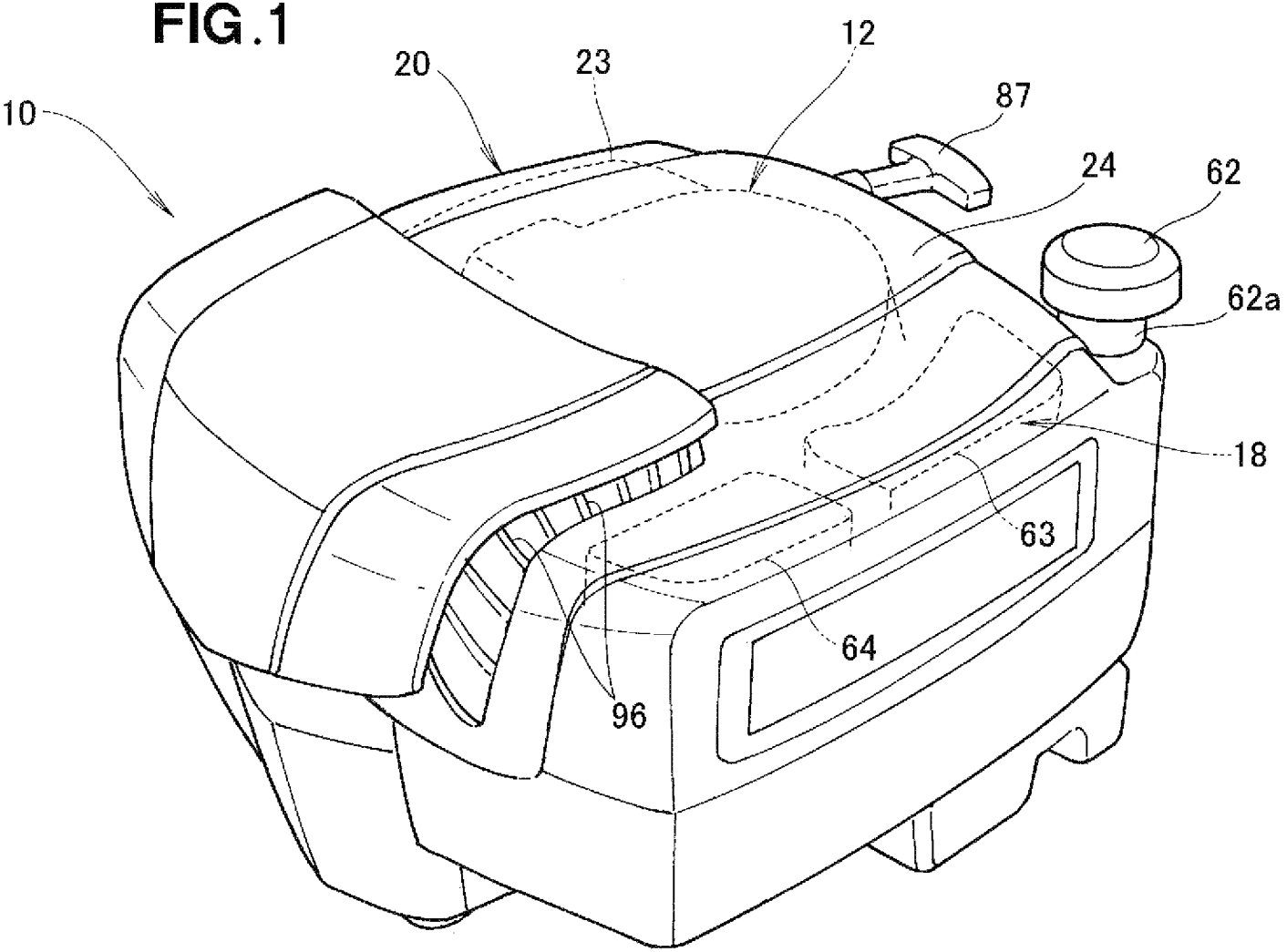
FIG. 1 is a perspective view of a cover structure of a general-purpose liquid-cooled engine according to a first embodiment of the present invention.
Figure 2:
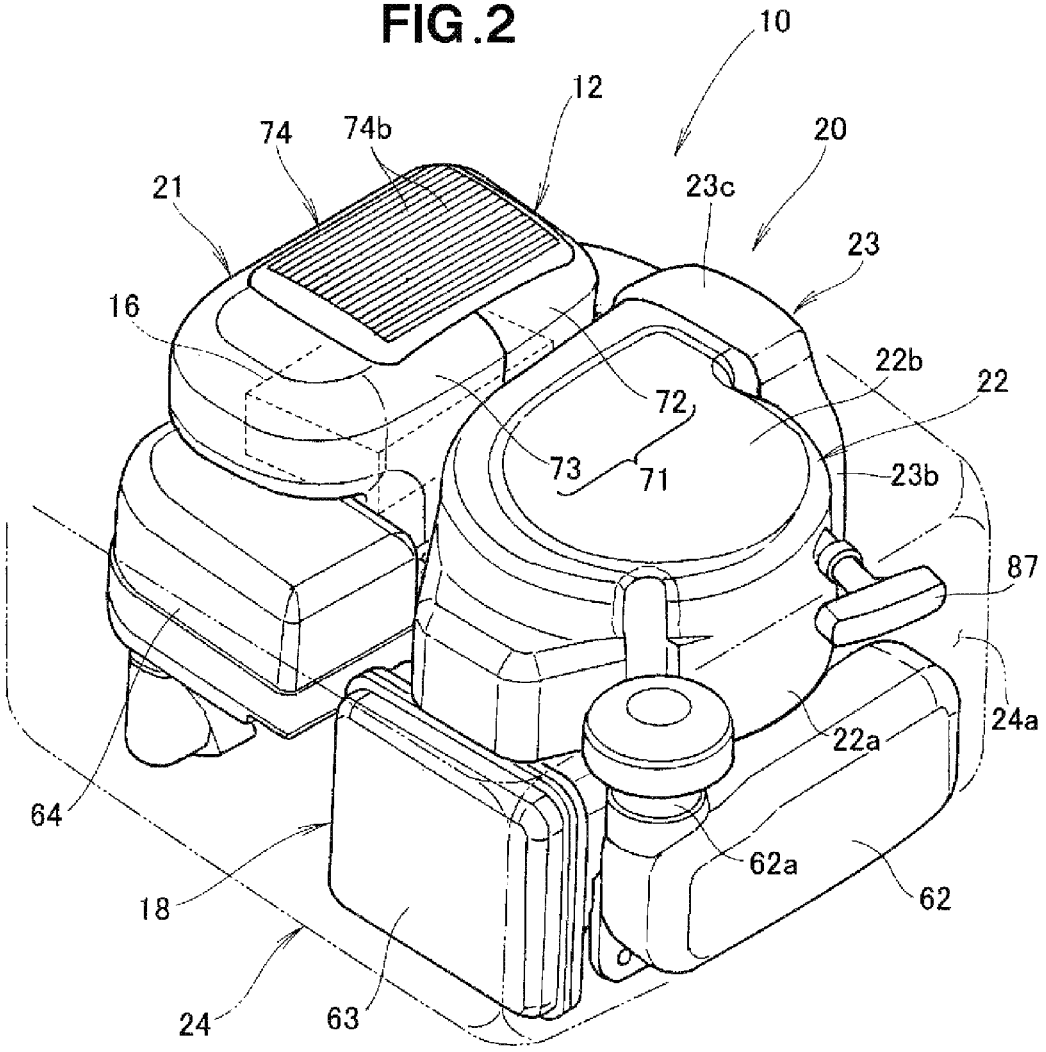
FIG. 2 is a perspective view of the general-purpose liquid-cooled engine of FIG. 1 with its external cover removed.

Referring to FIGS. 1 and 2, a general-purpose liquid-cooled engine generally designated by reference numeral 10 is provided with an entire engine 12 including an engine body 14 (see FIG. 4) and a radiator 16, and a cover structure 20 of the general-purpose liquid-cooled engine for enclosing the entire engine 12. A general-purpose engine of liquid cooling type can be, e.g., a general-purpose engine of water cooling type.

Figure 3:
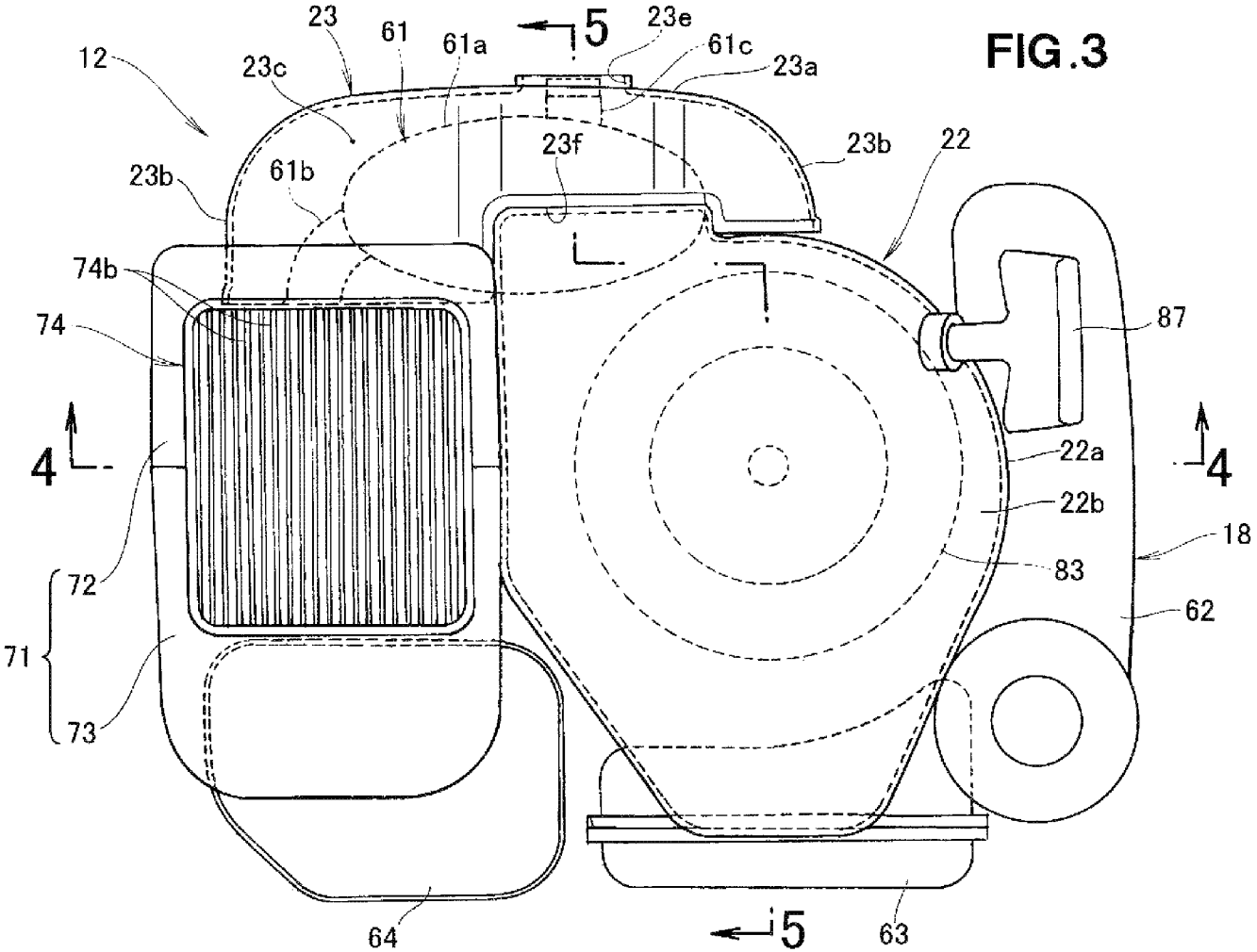
FIG. 3 is a top plan view of the general-purpose liquid-cooled engine depicted in FIG. 2.
Figure 4:
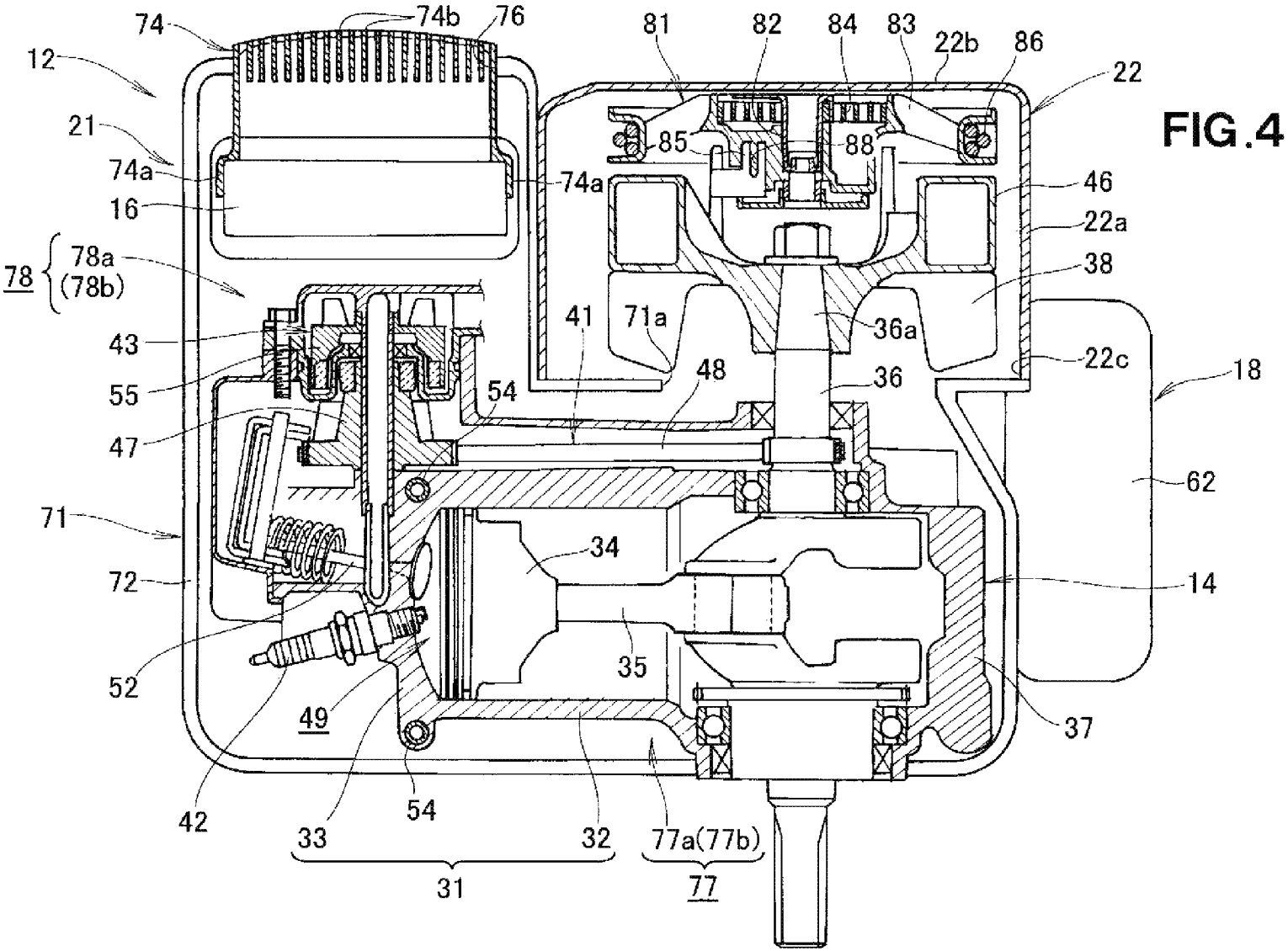
FIG. 4 is a cross-sectional view taken along line 4-4 of FIG. 3

As depicted in FIGS. 3 and 4, the entire engine 12 includes the engine body 14 having a piston 34 disposed within a cylinder block 32 of a cylinder block/head 31, the radiator 16 cooling the engine body 14, and peripheral accessories 18 disposed around the engine body 14.

Figure 5:
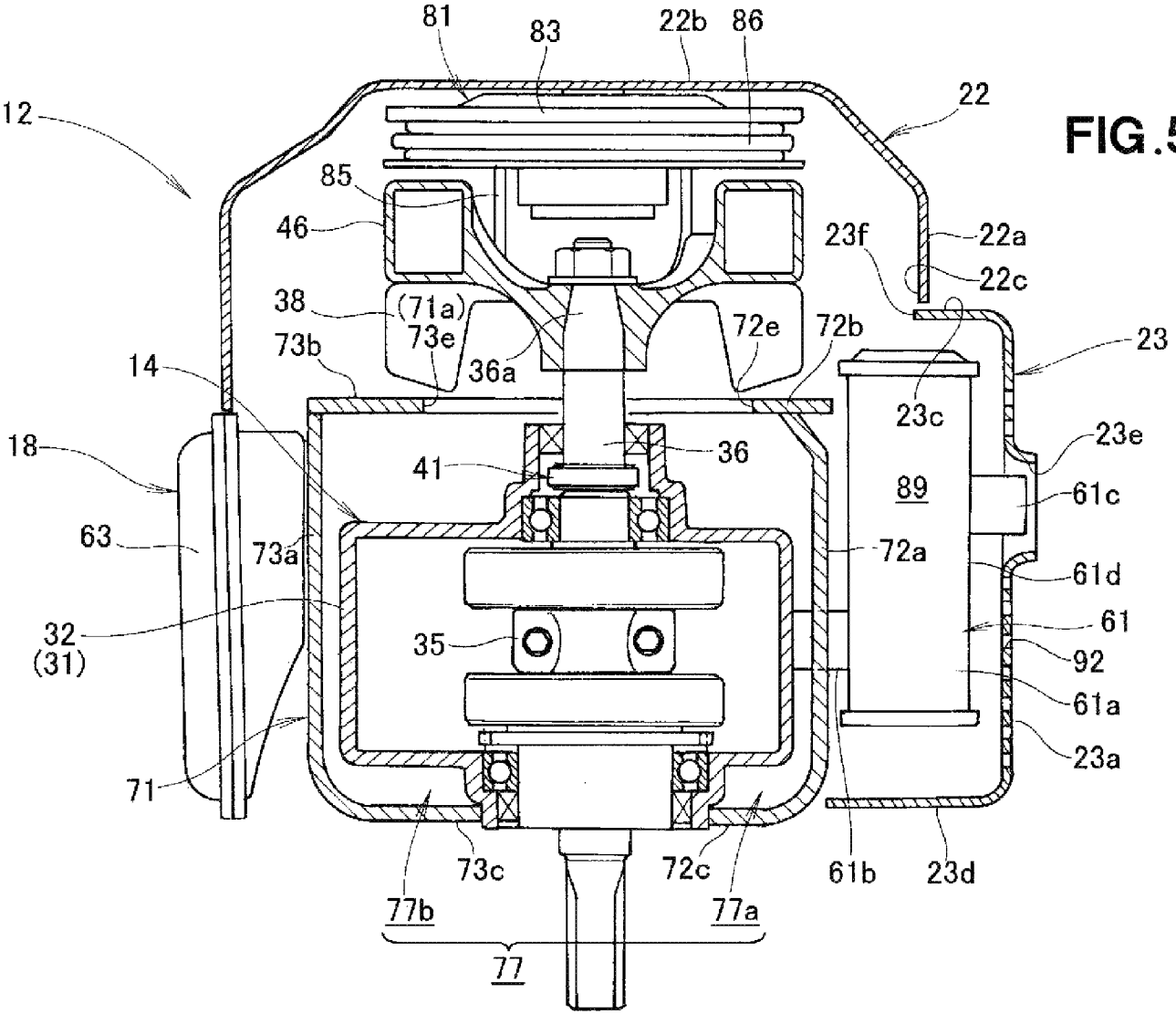
FIG. 5 is a cross-sectional view taken along line 5-5 of FIG. 3

As seen in FIGS. 4 and 5, the cylinder block/head 31 of the engine body 14 consists of the cylinder block 32 and a cylinder head 33 integrally formed with the cylinder block 32. The engine body 14 has the piston 34 disposed within the cylinder block 32, with the piston 34 being coupled via a connecting rod 32 to a crankshaft 36 that is housed in a crankcase 37.

The engine body 14 includes a cooling fan 38 disposed at an end 36*a* of the crankshaft 36 protruding from the crankcase 37, a valve-train mechanism 41 disposed on the cylinder head 33 and on the cylinder block/head 31, and a spark plug 42 and a cooling means 43 that are disposed on the cylinder head 33.

The cooling fan 38 is disposed on and coaxially with a flywheel 46. The flywheel 46 is disposed on and coaxially with the end 36*a* of the crankshaft 36 so that the flywheel 46 lies above the crankcase 37. Thus, the cooling fan 38 is disposed on and coaxially with the end 36*a* of the crankshaft 36 and lies above the crankcase 37. By turning the cooling fan 38, externally supplied cooling air can be delivered to the radiator 16 and the cooling air having cooled the radiator 16 can be delivered to a muffler 61. The flywheel 46 is a member for ensuring a smooth, rotation of the crankshaft 36.

The valve-train mechanism 41 includes a transmitting means 48 that transmits the rotation of the crankshaft 36 to a cam member 47, and an intake valve (not shown) and an exhaust valve 52 that act to open and close a combustion chamber 49 by the rotation of the cam member 47. Due to the presence of the valve-train mechanism 41, the transmitting means 48 transmits the rotation of the crankshaft 36 to the cam member 47 to thereby rotate the cam member 47. The rotation of the cam member 47 actuates the intake vale and the exhaust valve 52.

The cooling means 43 is laid (cast-in) in the periphery of the cylinder head 33 and includes a cooling passage 54 leading to the radiator 16, and a water pump 55 and a thermostat (not shown) that are disposed midway on the cooling passage 54. The water pump 55 is disposed above the cylinder head 33 and is coupled to the transmitting means 48. Thus, the rotation of the crankshaft 36 is transmitted via the transmitting means 48 to the water pump 55 to turn the water pump 55.

The radiator 16 is the same constituent member as a commonly used engine-cooling radiator.

The radiator 16 is disposed above the water pump 55 and is positioned adjacent to the cooling fan 38. Thus, by turning the cooling fan 38, a suction force of the cooling fan 38 is imparted to the radiator 16 to allow the cooling air to pass through the radiator 16.

The cooling passage 54 (part of which is not shown) of the cooling means 43 leads to the radiator 16. This enables the coolant having, cooled the engine body 14 to circulate via the cooling passage 54 to the radiator 16. By circulating the coolant having cooled the engine body 14 to the radiator 16, the coolant can be cooled by the radiator 16.

By virtue of the provision of the cooling means 43 and the radiator 16, the coolant in the cooling passage 54 is circulated by the action of the water pump 55 so that the engine body 14 can be cooled by the coolant. At, that time, when the temperature of the coolant does not rise up to a predetermined temperature, the thermostat acts to allow the coolant having cooled the engine body 14 to return via the water pump 55 to the engine body 14.

On the other hand, when the temperature of the coolant rises up to the predetermined temperature, the thermostat acts to allow the coolant having cooled the engine body 14 to be delivered via the water pump 55 to the radiator 16. The delivered coolant is cooled by the radiator 16 so that the cooled coolant is returned to the engine body 14 to cool the engine body 14.

Figure 6:
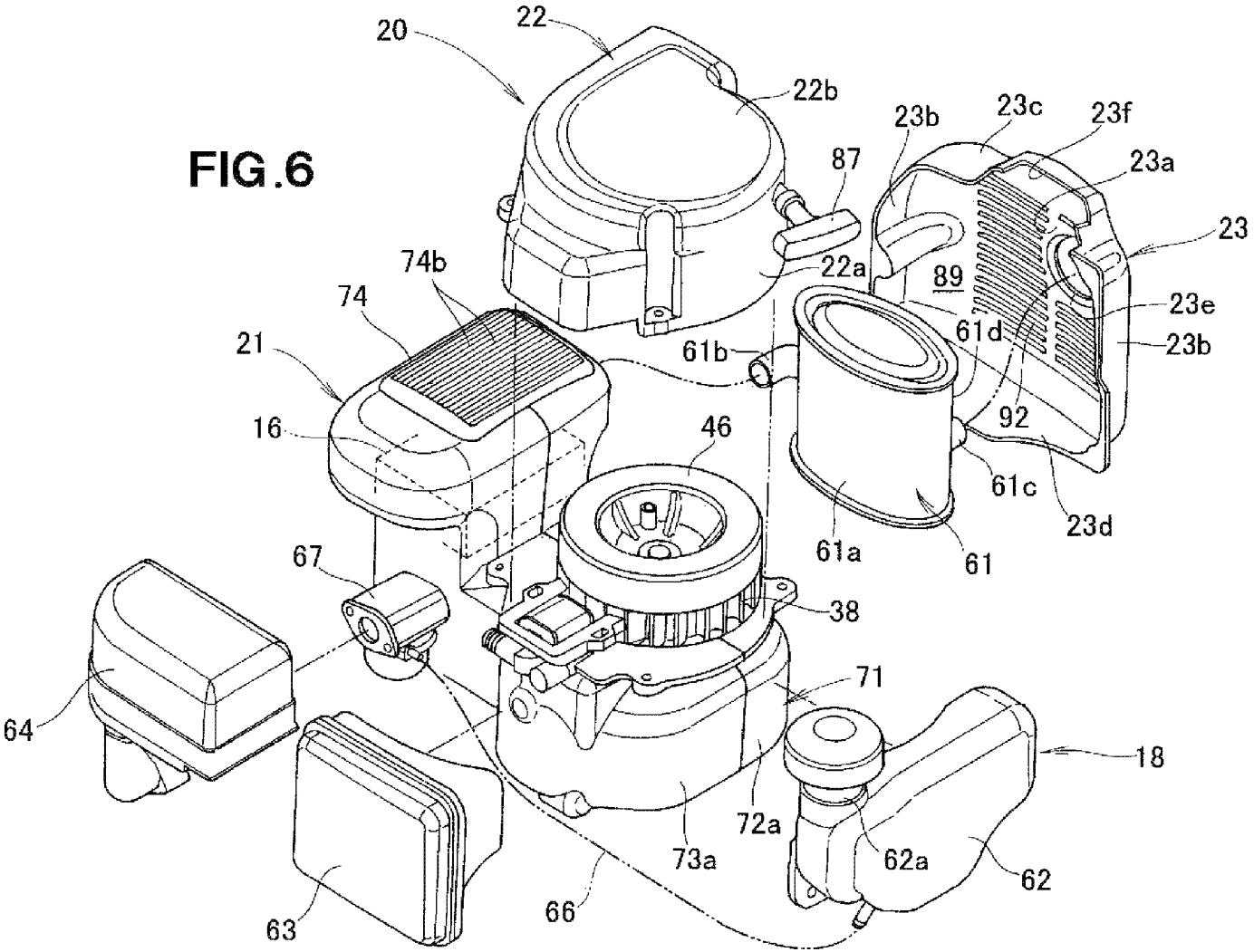
FIG. 6 is an exploded perspective view of the general-purpose liquid-cooled engine depicted in FIG. 2.

As depicted in FIGS. 3 and 6, the peripheral accessories 18 include the muffler 61, a fuel tank 62, an oil tank 63, and an air cleaner 64, which are disposed around the engine body 14 (FIG. 4). The peripheral accessories are enclosed by the cover structure 20.

The muffler 61 is disposed near and on one side of the cylinder head 33 (FIG. 4) of the engine body 14. The muffler 61 includes a muffler body 61*a* that opens via an exhaust communication pipe 61*b* into an exhaust port of the cylinder head 33, and an exhaust, pipe 61*c* protruding from the muffler body 61*a*. The muffler body 61*a* is formed to be, by way of example, substantially oval in plan view Due to the provision of the muffler 61, exhaust gas of the combustion chamber 49 (FIG. 4) is delivered via the exhaust port and the exhaust communication pipe 61*b* to the muffler body 61*a* so that the exhaust gas delivered to the muffler body 61*a* is emitted via the exhaust pipe 61*c* to the exterior.

The fuel tank 62 is a tank of a substantially rectangular shape and is disposed in the vicinity of the crankcase 37 (FIG. 4) of the engine body 14. The fuel tank 62 has at its one end a fuel supply port 62*a* and opens via a fuel supply pipe 66 into a carburetor 67. Fuel in the fuel tank 62 is delivered via the fuel supply pipe 66 to the carburetor 67. The fuel delivered to the carburetor 67 is mixed with air fed from the air cleaner 64 to the carburetor 67. The air-fuel mixture is delivered via the intake port to the combustion chamber 49 (FIG. 4).

By way of the carburetor 67, the air cleaner 64 is disposed near and on the other side of the cylinder head 33 provided on the engine body 14 (FIG. 4). The air cleaner 64 functions to clean the externally fed air through its filter to deliver the cleaned air to the carburetor 67.

The oil tank 63 is positioned adjacent to the air cleaner 64 and is disposed near and on the other side of the crankcase 37 (FIG. 4) so that the oil tank 63 intervenes between the air cleaner 64 and the fuel tank 62. The oil tank 63 leads through an oil supply pipe to the interior of the crankcase 37. Lubricant in the oil tank 63 is delivered via the oil supply pipe to the interior of the crankcase 37 (FIG. 4).

As depicted in FIGS. 1 and 6, the cover structure 20 includes an engine cover 21 covering the engine body 14 and the radiator 16 (FIG. 4), a recoil cover 22 covering the cooling fan 38 of the engine body 14, a muffler cover 23 covering the muffler 61 of the peripheral accessories 18, and an exterior cover 24 covering the entire engine 12 (FIG. 4).

Figure 7:
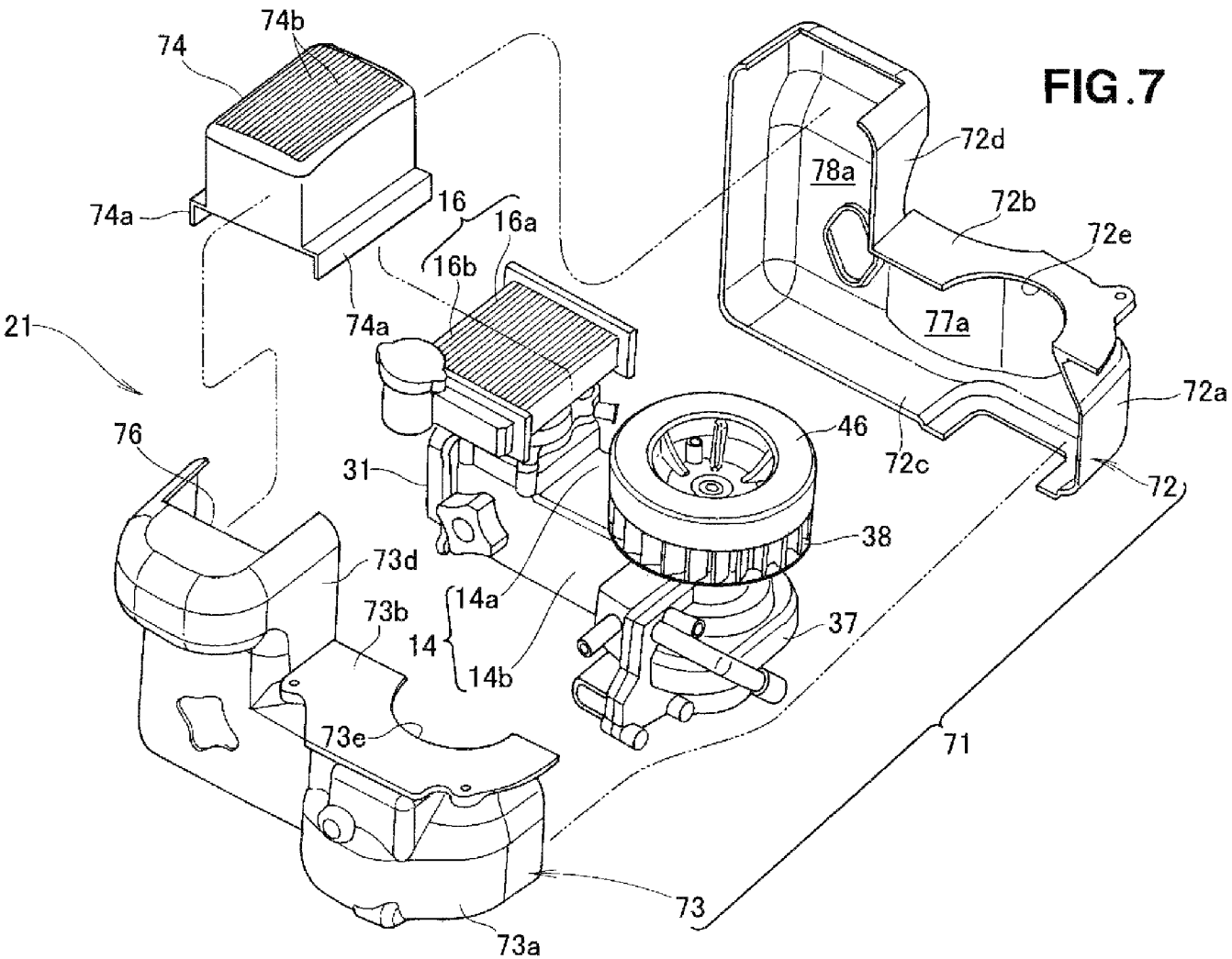
FIG. 7 is an exploded perspective view of an engine cover depicted in FIG. 6.

As seen in FIGS. 4 and 7, the engine cover 21 includes a cover body 71 covering the engine body 14 and the radiator 16, and a radiator guard 74 mounted on the cover body 71.

The cover body 71 is substantially L-shaped and has a cooling an inlet 76 for introducing cooling air into the interior. The radiator 16 is supported via the radiator guard 74 on the cooling air inlet 76. Supporting the radiator 16 via the radiator guard 74 on the cooling air inlet 76 enables cooling air taken in from the cooling air inlet 76 to pass through the radiator 16.

The cover body 71 is divided into two halves, i.e., a substantially L-shaped cover half segment 72 on one hand and a substantially L-shaped cover half segment 73 on the other. The cover half segment 72 on one hand and the cover half segment 73 on the other are formed to be substantially line-symmetrical with respect to a division line.

The cover half segment 72 on one hand has a housing space 77*a* on one hand capable of housing a half 14*a* on one hand of the engine body 14 and an upper housing, space 78*a* on one hand capable of housing a half 16*a* on one hand of the radiator 16.

More specifically, the cover half segment 72 on one hand includes a wall portion 72*a* on one hand covering a wall portion on one hand of the engine body 14, a ceiling portion 72*b* on one hand covering an upper half on one hand of the engine body 14, and a floor portion 72*c* on one hand covering a lower half on one hand of the engine body 14. The housing space 77*a* on one hand housing the half 14*a* on one hand of the engine body 14 is defined by the wall portion 72*a* on one hand, the ceiling portion 72*b* on one hand, and the floor portion 72*c* on one hand. Thus, the half 14*a* on one hand of the engine body 14 can be enclosed by the cover half segment 72 on one hand.

Moreover, the cover half segment 72 on one hand includes an upper wall portion 72*d* on one hand upwardly extending from the end of the ceiling portion 72*b* on one hand. The upper housing space 78*a* on one hand is defined by the upper wall portion 72*d* on one hand. The upper housing space 78*a* on one hand houses the half 16*a* on one hand of the radiator 16. Thus, the half 16*a* on one hand of the radiator 16 can be enclosed by the cover half segment 72 on one hand.

The cover half segment 73 on the other has a housing space 77*b* (FIG. 5) on the other capable of housing a half 14*b* on the other of the engine body 14 and an upper housing space 78*b* (FIG. 4) on the other capable of housing a half 16*b* on the other of the radiator 16.

More specifically, the cover half segment 73 on the other includes a wall portion 73*a* on the other covering a wall portion on the other of the engine body 14, a ceiling portion 73*b* on the other covering an upper half on the other of the engine body 14, and a floor portion 73*c* (FIG. 5) on the other covering a lower half on the other of the engine body 14. The housing space 77*b* (FIG. 5) on the other housing the half 14*b* on the other of the engine body 14 is defined by the wall portion 73*a* on the other, the ceiling portion 73*b* on the other, and the floor portion 73*c* on the other. Thus, the half 14*b* on the other of the engine body 14 can be enclosed by the cover half segment 73 on the other.

Moreover, the cover half segment 73 on the other includes an upper wall portion 73*d* on the other upwardly extending from the end of the ceiling portion 73*b* on the other. The upper housing space 78*b* (FIG. 4) on the other is defined by the upper wall portion 73*d* on the other. The upper housing space 78*b* on the other houses the half 16*b* on the other of the radiator 16. Thus, the half 16*b* on the other of the radiator 16 can be enclosed by the cover half segment 73 on the other.

The cover half segment 72 on one hand and the cover half segment 73 on the other are assembled together, with the radiator guard 74 interposed between the upper wall portion 72*d* on one hand and the upper wall portion 73*d* on the other, to thereby fabricate the engine cover 21. By fabricating the engine cover 21, as depicted in FIG. 5, a housing space 77 (the interior of the engine cover) is formed by the housing space 77*a* on one hand and the housing space 77*b* on the other. The engine body 1 is housed in the housing space 77.

Furthermore, by fabricating the engine cover 21, as depicted in FIG. 4, an upper housing space 78 (the interior of the engine cover) is formed by the upper housing space 78*a* on one hand and the upper housing space 78*b* on the other, with the formation of the cooling air inlet 76. The upper housing space 78 opens into the housing space 77 and leads to the cooling air inlet 76.

The radiator guard 74 is mounted on the cooling air inlet 76, with a support portion 74*a* of the radiator guard 74 lying within the upper housing space 78. By placing the radiator 16 on the support portion 74*a* of the radiator guard 74, the radiator 16 is housed in the upper housing space 78.

The radiator guard 74 has a guard louver 74*b* that is fitted in the cooling air inlet 76. The guard louver 74*b* includes a plurality of louver elements spaced apart at a predetermined interval. Thus, cooling air is delivered from the exterior of the engine cover 21 through the guard louver 74*b* (i.e., the cooling air inlet 76) into the upper housing space 78. By providing the radiator guard 74 with the guard louver 74*b*, the radiator 16 can be guarded by the radiator guard 74.

As depicted in FIGS. 5 and 7, the cooling fan 38 is positioned so as to adjoin the upper outside of the ceiling portion 72*b* on one hand and the ceiling portion 73*b* (the external surface of the cover body 71) on the other of the cover body 71. The ceiling portion 72*b* on one hand is formed with a recessed portion 72*e* on one hand at a lower part of the cooling fan 38. The ceiling portion 73*b* on the other is formed with a recessed portion 73*e* on the other at a lower part of the cooling fan 38. Thus, the recessed portion 72*e* on one hand and the recessed portion 73*e* on the other cooperatively define a cover opening 71*a* that allows the cooling fan 38 to communicate with the housing space 77.

As depicted in FIGS. 4 and 6, the cooling fan 38 is covered by the recoil cover 22. The recoil cover 22 has a peripheral side wall 22*a*, a top 22*b* closing the upper end of the peripheral side wall 22*a*, and a lower opening 22*c* at the lower end of the peripheral side wall 22*a*.

The lower opening 22*c* of the recoil cover 22 faces the cover opening 71*a*. Thus, the lower opening 22*c* of the recoil cover 22 leads via the cover opening 71*a*, the housing space 77, and the upper housing space 78 to the cooling air inlet 76. The radiator 16 is mounted on the cooling air inlet 76. The radiator 16 is positioned adjacent to the cooling fan 38. Therefore, turning the cooling fan 38 enables cooling air to be satisfactorily delivered to the cooling air inlet 76 (i.e., the radiator 16). In consequence, a coolant in the radiator 16 can properly be cooled by the cooling air and the general-purpose liquid-cooled engine 10 can effectively be cooled by the coolant thus cooled.

The recoil cover 22 incorporates a recoil starter 81 for starting the engine. The recoil starter 81 includes, a support shaft 82 disposed on a top 22*b* of the recoil cover 22, a pulley 83 rotatably supported on the support shaft 82, a recoil spring 84 coupled to the pulley 83 and the support shaft 82, a one-way clutch 85 disposed on the pulley 83, a cable 86 having a base end coupled to the pulley 83 and wound around the, outer periphery of the pulley 83, and a recoil knob 87 disposed at the tip of the cable 86.

The support shaft 82 extends toward the crankshaft 36 and is disposed coaxially with the crankshaft 36. The one-way clutch 85 has a locking pawl (not shown) that is locked in a locking groove 88 of the flywheel 46.

Thus, by holding and pulling the recoil knob 87 by hand, the pulley 83 rotates against a spring force of the recoil spring 84. Rotation of the pulley 83 rotates the crankshaft 36 by way of the flywheel 46. Rotation of the crankshaft 36 puts the general-purpose liquid-cooled engine 10 in motion. The start-up of the general-purpose liquid-cooled engine 10 disengages the locking pawl from the locking groove 88 of the flywheel 46. By releasing the hand from the recoil knob 87, the pulley 83 is rotated by a spring force of the recoil spring 84 so that the cable 86 is wound around the pulley 83.

In this manner, the recoil starter 81 is incorporated in the recoil cover 22, and the cooling fan 38 is covered by that recoil cover 22.

Usually, in the general-purpose engine, the recoil starter 81 is disposed in the vicinity of the cooling fan 38. Therefore, the recoil cover 22 of the recoil starter 81 is used also as a cover of the cooling fan 38. It is thus possible to remove the dedicated cover, for the cooling fan 38 and to reduce the number of components.

In addition, the configuration is such that only the engine body 14 and the radiator 16 are covered by the engine cover 21 and that only the cooling fan 38 and the recoil starter 81 are covered by the recoil cover 22. Thus, the dimensions of the recoil cover 22 can be reduced as compared with the case where the entire engine is collectively covered by the engine cover as in the prior art. Reduction in the dimensions of the recoil cover 22 enables the recoil cover 22 to individually and effectively cover the parts generating a relatively high level of noise such as the cooling fan 38.

By effectively covering the parts generating a relatively high level of noise such as the cooling fan 28 in this manner, a preferred noise-proof effect can be ensured.

As depicted in FIGS. 5 and 6, the wall portion 72*a* on one hand of the cover body 71 is disposed near and on one side of the cylinder head 33 (FIG. 4), and the muffler 61 is disposed around the outside of the wall portion 72*a* on one hand. This muffler 61 is covered by the muffler cover 23. The muffler cover 23 is disposed around the outside of the wall portion 72*a* (i.e., on the outside of the engine cover 21) so as to externally cover the muffler 61.

The muffler cover 23 includes an outer wall portion 23*a* opposite to (confronting) an external surface 61*d* of the muffler body 61*a*, both-side projection pieces 23*b* projecting from both sides of the outer wall portion 23*a* toward the wall portion 72*a* on one hand, an upper projection piece 23*c* projecting from an upper end of the outer wall portion 23*a* toward the cooling fan 38, and a lower projection piece 23*d* projecting from a lower end of the outer wall portion 23*a* toward the wall portion 72*a* on one hand.

A cover exhaust port 23*e* is disposed on the outer wall portion 23*a* of the muffler cover 23. The exhaust pipe 61*c* of the muffler 61 is fitted in the cover exhaust port 23*e*. Thus, exhaust gas delivered through the exhaust communication pipe 61*b* to the muffler body 61*a* is emitted through the exhaust pipe 61*c* to the exterior of the muffler cover 23.

The upper projection piece 23*c* of the muffler cover 23 is provided with a communication port 23*f*. Provision of the communication port 23*f* on the upper projection piece 23*c* allows an internal space (the interior of the muffler cover) 89 of the muffler cover 23 to communicate with the lower opening 22*c* (the internal space of the recoil cover 22). Thus, cooling air fed from the cooling fan 38 is delivered through the communication port 23*f* from the lower opening 22*c* of the recoil cover 22 to the internal space 89 of the muffler cover 23. The muffler 61 is cooled by the cooling air delivered to the internal space 89.

On the outer wall portion 23*a* of the muffler cover 23 is disposed a louver 92 at a part avoiding the cover exhaust port 23*e*. The louver 92 has a plurality of louver elements spaced apart at a predetermined interval. Hence, cooling air delivered to the internal space 89 of the muffler cover 23 to cool the muffler 61 is emitted through the louver 92 to the exterior of the muffler cover 23.

The configuration is such that only the engine body 14 and the radiator 16 are covered by the engine cover 21 and that only the muffler 61 is covered with the muffler cover 23. Consequently, the dimensions of the engine cover 21 and the muffler cover 23 can be reduced as compared with the case where the entire engine is collectively covered by the engine cover as in the prior art. Reduction in the dimensions of the engine cover 21 and the muffler cover 23 enables the engine cover 21 and the muffler cover 23 to individually and effectively cover the parts generating a relatively high level of noise such as the combustion chamber 49 (FIG. 4) and the muffler 61. By effectively covering the parts generating a relatively high level of noise such as the combustion chamber 49 and the muffler 61 in this manner, a satisfactory noise-proof effect can be ensured.

As depicted in FIGS. 1 and 2, the exterior cover 24 is formed to be substantially rectangular so as to cover the entire engine 12. The exterior cover 24 has an exterior louver 96 formed at a part corresponding to the radiator guard 74, and a wall portion 24*a* opposite to the exterior louver 96 from which the recoil knob 87 and the fuel supply port 62*a* protrude. The exterior louver 96 has a plurality of, louver elements spaced apart at a predetermined interval.

Formation of the exterior louver 96 at a part corresponding to the radiator guard 74 enables the external air to be delivered as the cooling air from the outside of the exterior cover 24 to the interior of the exterior cover 24. The cooling air delivered to the interior of the exterior cover 24 can be delivered through the guard louver 74*b* (the cooling air inlet 76) to the upper housing space 78 (FIG. 4) of the engine cover 21. Delivery of the cooling air to the upper housing space 78 allows the delivered cooling air to pass through the radiator 16. Delivery of the cooling air to the radiator enables the coolant in the radiator 16 to be cooled.

The configuration is such that the entire engine 12 including the engine cover 21 and the muffler cover 23 is covered by the exterior cover 24. By covering the entire engine 12 by the exterior cover 24, it is possible to ensure a more preferred noise-proof effect and to improve the external appearance of the general-purpose liquid-cooled engine.

Referring next to FIGS. 8A to 9B, description will be given of an example in which cooling air is delivered to the radiator 16 and the muffler 61 in the cover structure 20 of the general-purpose liquid-cooled engine.

Figure 8A:
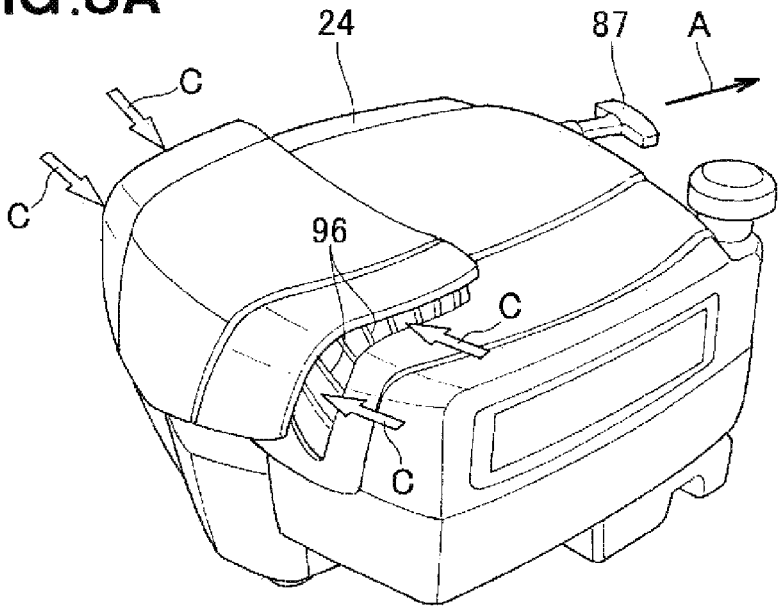
FIG. 8A depicts the cover structure of FIG. 1.

As seen in FIG. 8A, the recoil knob 87 is held and pulled by hand as indicated by an arrow A.

Figure 8B:
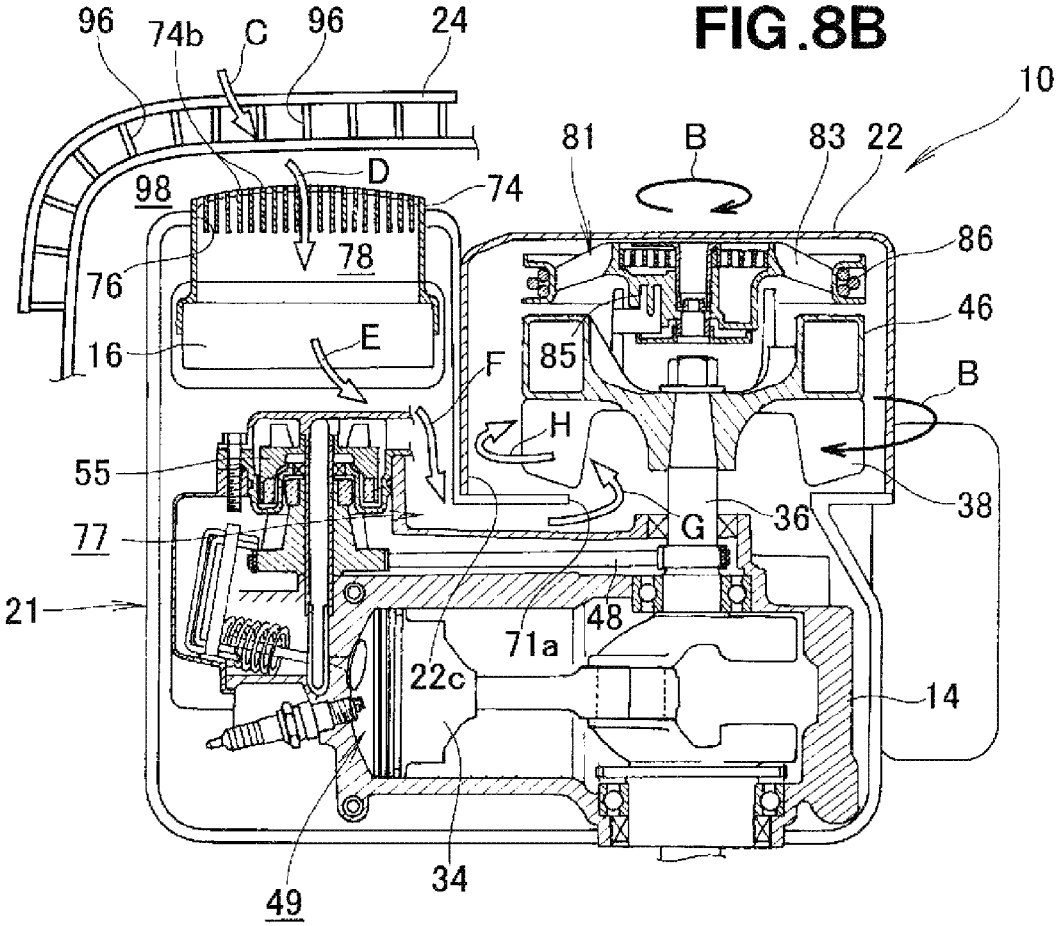
FIG. 8B is a cross-sectional view of an example in which cooling an is delivered to a radiator.

As seen in FIG. 8B, the cable 86 of the recoil starter 81 is drawn out so that the pulley 83 rotates as indicated by an arrow B.

Rotation of the pulley 83 causes the flywheel 46 to, rotate via the one-way clutch 85 as indicated by the arrow B. Rotation of the flywheel 46 causes the cooling fan 38 and the crankshaft 36 to rotate as indicated by the arrow B. Rotation of the crankshaft 36 causes the piston 34 to move between the top death center and the bottom death center so that the air-fuel mixture is ignited in the combustion chamber 49. Ignition of the air-fuel mixture starts up the general-purpose liquid-cooled engine 10.

Activation of the general-purpose liquid-cooled engine 10 causes rotation of the crankshaft 36, which, in turn, rotates the cooling fan 38 as indicated by the arrow B. Furthermore, as a result of rotation of the crankshaft 36, the rotation of the crankshaft 36 is transmitted via the transmitting means 48 to the water pump 55 to rotate the water pump 55. Rotation of the water pump 55 allows the coolant to circulate between the radiator 16 and the engine body 14.

When the cooling fan 38 rotates in this state a suction force is generated in the cooling fan 38. Generation of the suction force in the cooling fan 38 allows the external air to be delivered as the cooling air from the outside of the exterior cover 24 to an interior 98 of the exterior cover 24 as indicated by an arrow C.

The cooling air fed to the interior 98 of the exterior cover 24 is delivered via the guard louver 74*b* (the cooling air inlet 76) of the radiator guard 74 to the upper housing space 78 of the engine cover 21 as indicated by an arrow D.

The cooling air fed to the upper housing space 78 passes through the radiator 16 as indicated by an arrow E. Passage of the cooling air through the radiator 16 allows the coolant in the radiator 16 to be cooled by the cooling air. The coolant cooled by the cooling air circulates from the interior of the radiator 16 to the engine body 14 by the action of the water pump 55 to thereby cool the engine body 14.

On the other hand, the cooling air passing through the radiator 16 is delivered to the housing space 77 as indicated by an arrow F. The cooling air fed to the housing space 77 is delivered through the cover opening 71*a* of the engine cover 21 (the cover body 71) and the lower opening 22*c* of the recoil cover 22 to the interior of the recoil cover 22 as indicated by an arrow G. The cooling air fed to the interior of the recoil cover 22 is guided by the cooling fan 38 to the outer peripheral side of the cooling fan 38 as indicated by an arrow H.

Figure 9A:
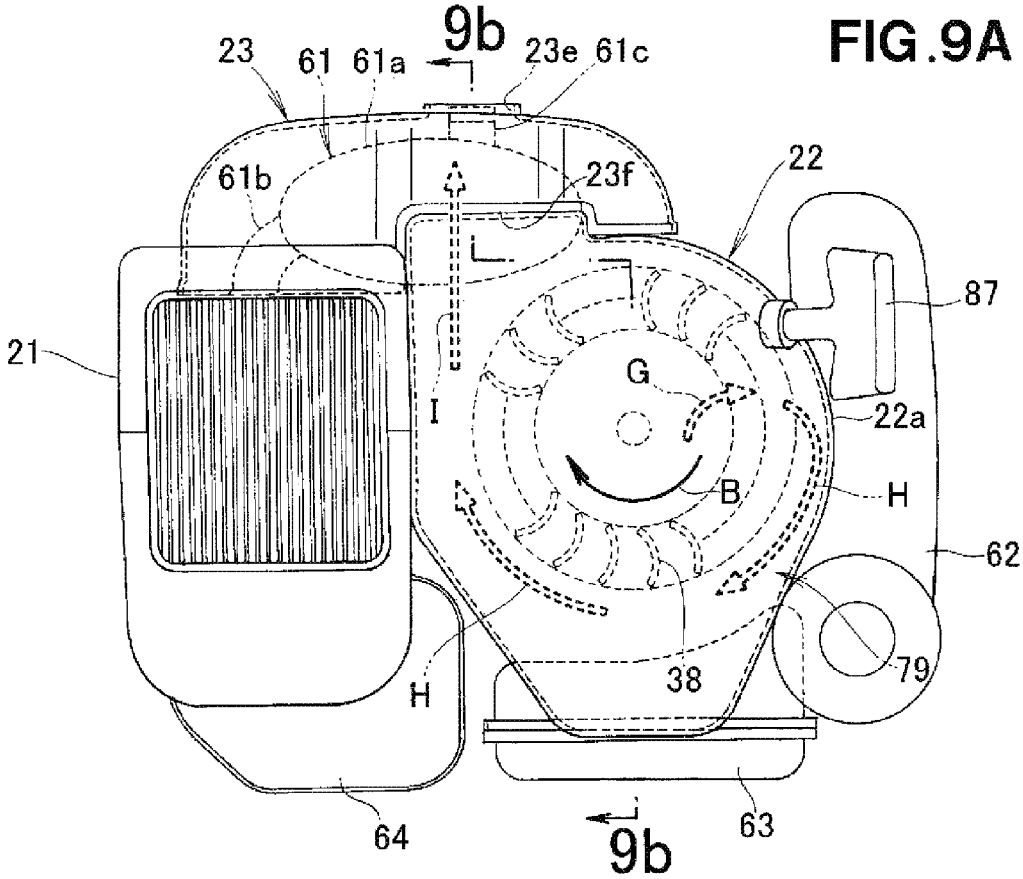
FIG. 9A depicts an example of the cover structure according to the first embodiment in which cooling air is delivered to a muffler.

As depicted in FIG. 9A, the cooling air guided to the outer peripheral side of the cooling fan 38 is delivered as indicated by the arrow H along a space 79 defined between the outer periphery of the cooling fan 38 and the peripheral side wall 22*a* of the recoil cover 22. The cooling air delivered along the space 79 on the outer peripheral side of the cooling fan 38 is discharged from the cooling fan 38 toward the communication port 23*f* of the muffler cover 23 as indicated by an arrow I.

Figure 9B:
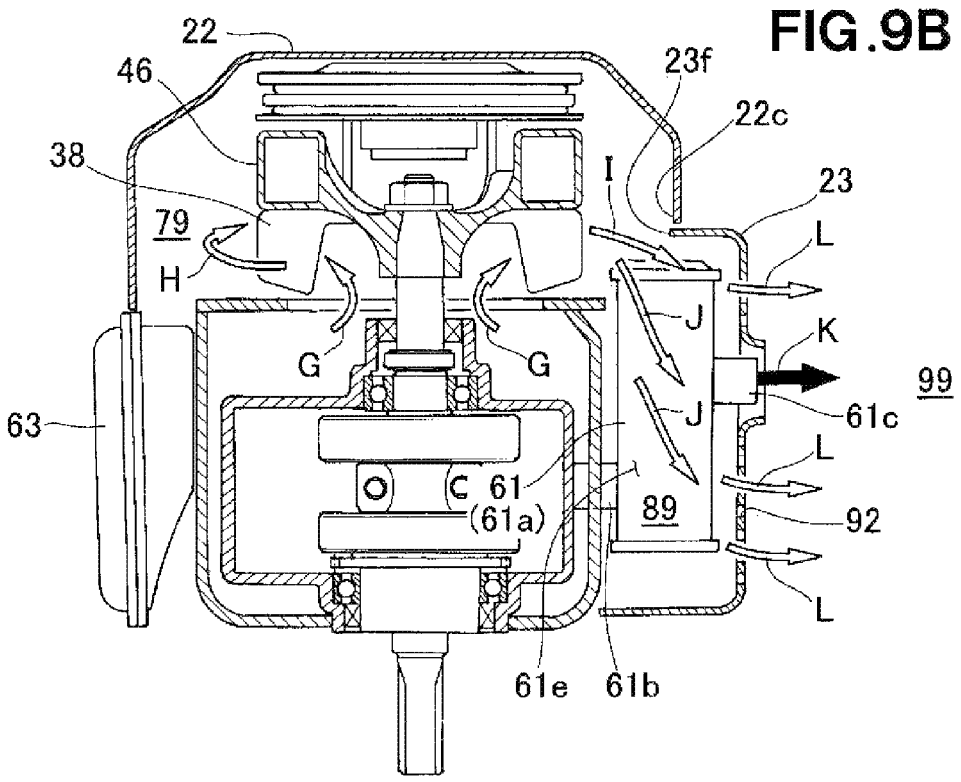
FIG. 9B is a cross-sectional view taken along line 9*b*-9*b* of FIG. 9A.

As depicted in FIG. 9B, the cooling an discharged as indicated by the arrow I toward the communication port 23*f* of the, muffler cover 23 is delivered through the communication port 23*f* from the lower opening 22*c* of the recoil cover 22 to the internal space 89 of the muffler cover 23. The cooling air fed to the internal space 89 of the muffler cover 23 is delivered along, a surface 61*e* of the muffler 61 (the muffler body 61*a*) as indicated by an arrow J.

An exhaust gas is delivered through the exhaust communication pipe 61*b* from the interior of the combustion chamber 49 (FIG. 4) to the muffler body 61*a*. The exhaust gas fed to the muffler body 61*a* is discharged through the exhaust pipe 61*c* to an exterior 99 of the muffler cover 23 as indicated by an arrow K.

By delivering the exhaust gas to the interior of the muffler body 61*a* in this manner, the muffler body 61*a* is heated by the heat of the exhaust gas. Accordingly, the cooling air is supplied along the surface 61*e* of the muffler body 61*a* to thereby lower the temperature of the muffler body 61*a*. The cooling air having cooled the muffler body 61*a* is discharged through the louver 92 to the exterior 99 of the muffler cover 23 as indicated by an arrow L.

(Second Embodiment)

A second embodiment will then be described with reference to FIGS. 10 and 11. In the second embodiment, the same or similar members as in the first embodiment are designated by the same reference numerals and explanations thereof will be omitted.

Figure 10:
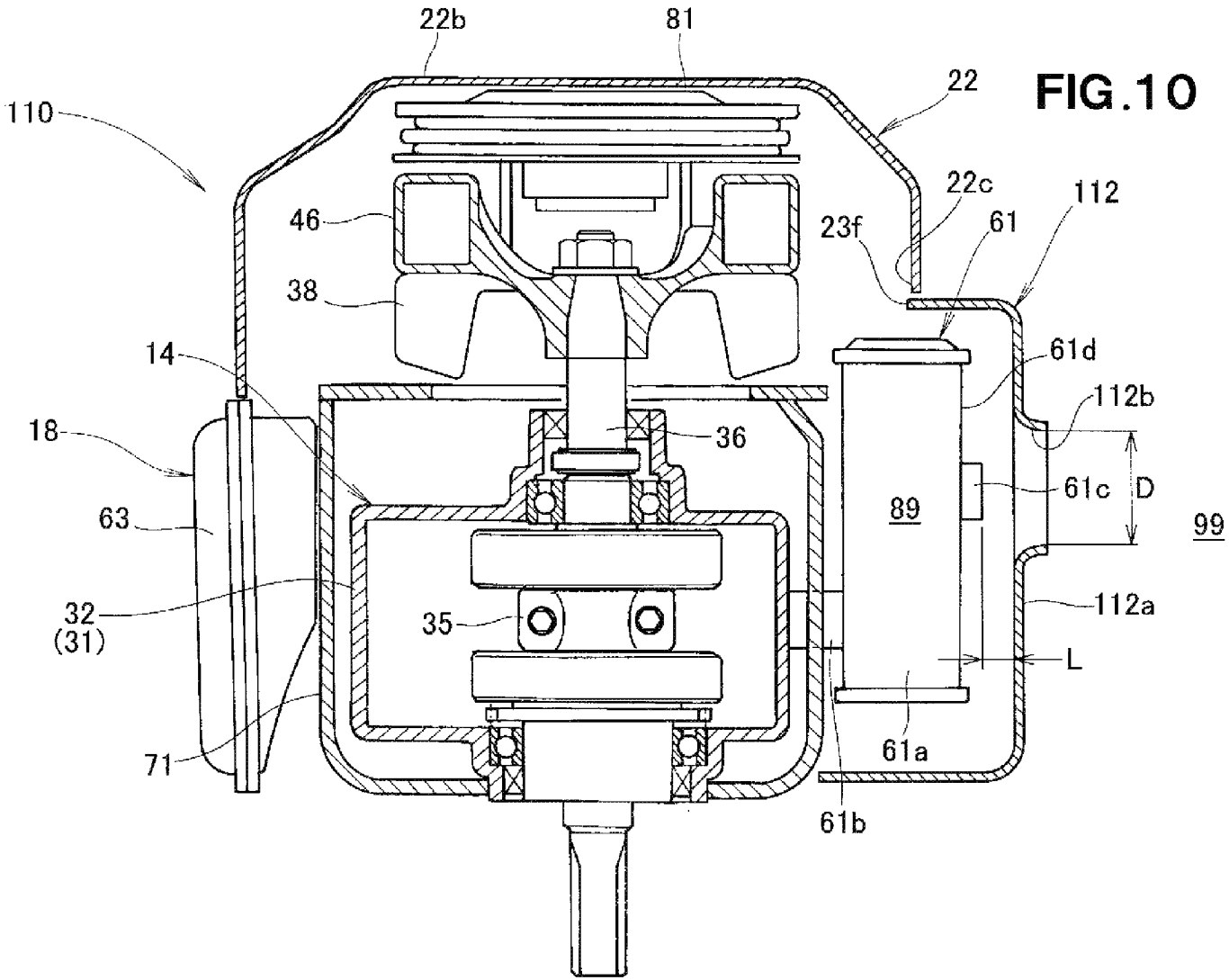
FIG. 10 is a cross-sectional view of a cover structure of the general-purpose liquid-cooled engine according to a second embodiment of the present invention.

As depicted in FIG. 10, a cover structure 110 of the general-purpose liquid-cooled engine (hereinafter abbreviated to "cover structure") according to the second embodiment is provided with a muffler cover 112 in place of the muffler cover 23 of the first embodiment, with the other configurations being the same as those of the cover structure 20 of the first embodiment.

The muffler cover 112 has an outer wall portion 112*a* confronting the external surface 61*d* of the muffler body 61*a*. The outer wall portion 112*a* is a wall portion substantially similar to the outer wall portion 23*a* of the first embodiment and is provided with a cover exhaust port 112*b* at a part opposite to (confronting) the exhaust pipe 61*c* of the muffler 61. The cover exhaust port 112*b* has a port diameter larger than that of the cover exhaust port 23*e* of the first embodiment. The cover exhaust port 112*b* is positioned apart away by a predetermined length L from the exhaust pipe 61*c*.

In this manner, the configuration is such that the cover exhaust port 112*b* is positioned apart away by a predetermined length L from the exhaust pipe 61*c* and that the cover exhaust port 112*b* has a larger port diameter D. Accordingly, exhaust gas from the exhaust pipe 61*c* and cooling air having cooled the muffler body 61*a* are delivered to the cover exhaust port 112*b* in the internal space 89 of the muffler cover 112. This enables the exhaust gas and the cooling air to be mixed in the vicinity of the cover exhaust port 112*b* in the internal space 89 of the muffler cover 112, for the discharge from the cover exhaust port 112*b* to the exterior 99.

Figure 11:
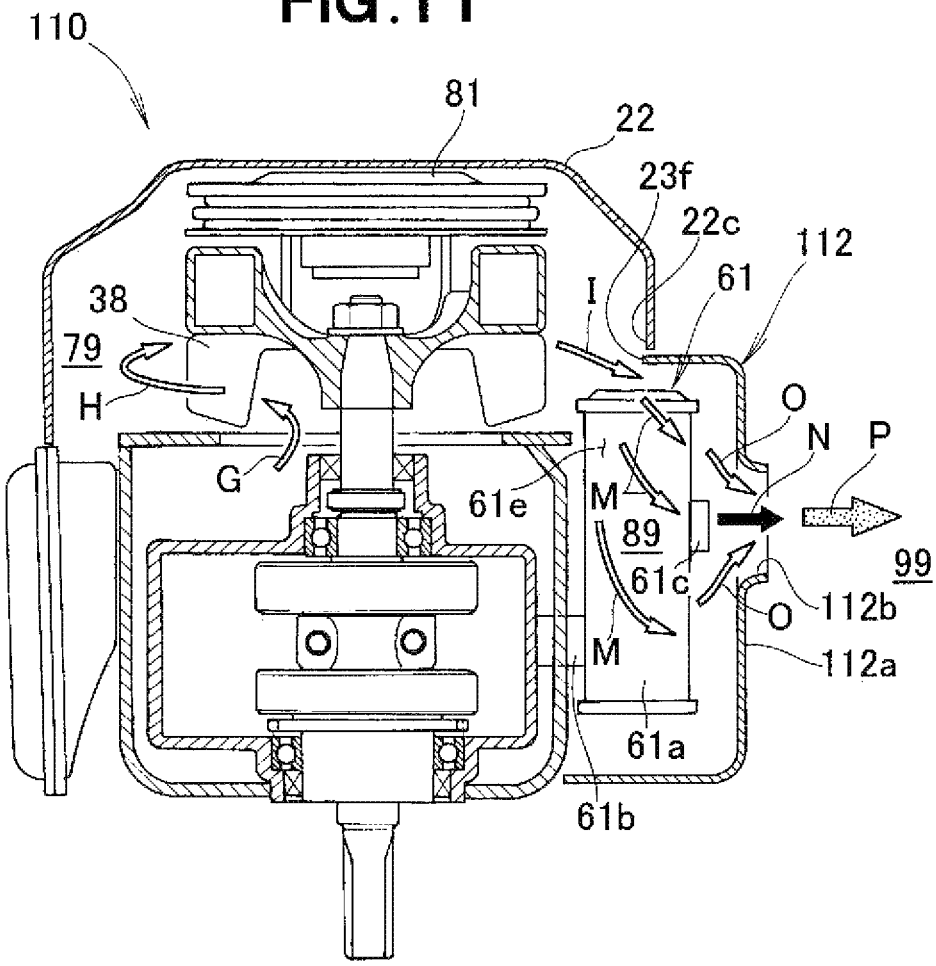
FIG. 11 is a sectional-view of the cover structure according to the second embodiment in which exhaust gas and cooling air are mixed.

Description will then be given of an example of delivering the cooling air to the muffler 61 in the cover structure 110 of the general-purpose liquid-cooled engine with reference to FIG. 11.

Referring to FIG. 11, the cooling air guided by the cooling fan 38 as indicated by the arrow H is discharged from the cooling fan 38 toward the communication port 23*f* of the muffler cover 112 as indicated by the arrow I. The cooling air discharged toward the communication port 23*f* is delivered through the communication port 23*f* from the lower opening 22*c* of the recoil cover 22 to the internal space 89 of the muffler cover 112. The cooling air fed to the internal space 89 of the muffler cover 112 is delivered along the surface 61*e* of the muffler 61 (the muffler body 61*a*) as indicated by an arrow M.

To the muffler body 61*a* is delivered an exhaust gas through the exhaust communication pipe 61*b* from the interior of the combustion chamber 49 (FIG. 4). The exhaust gas fed to the muffler body 61*a* is discharged through the exhaust pipe 61*c* toward the cover exhaust port 112*b* of the muffler cover 112 as indicated by an arrow N. As a result of delivering the exhaust gas into the muffler body 61*a* in this manner, the muffler body 61*a* is heated by the heat of the exhaust gas. Accordingly, a cooling air is supplied along the surface 61*e* of the muffler body 61*a* so that the temperature of the muffler body 61*a* can fall.

The cooling air having cooled the muffler body 61*a* is delivered toward the cover exhaust port 112*b* as indicated by an arrow O. The exhaust gas is discharged from the exhaust pipe 61*c* to the cover exhaust port 112*b* in the internal space 89 of the muffler cover 112. As a result, the exhaust gas and the cooling air are mixed together in the vicinity of the cover exhaust port 112*b* in the internal space 89 of the muffler cover 112. The mixture of the exhaust gas and the cooling air is discharged from the cover exhaust port 112*b* to the exterior 99 of the muffler cover 112.

By mixing the exhaust gas and the cooling air in the internal space 89 of the muffler cover 112 in this manner, the temperature of the exhaust gas can fall more. This enables the exhaust gas discharged to the exterior 99 of the muffler, cover 112 to have a lower temperature.

It is natural that the cover structure of the general-purpose liquid-cooled engine according to the present invention is not limited to the first and the second embodiments as set forth hereinabove, and can appropriately be variously changed or improved. Although in the first and the second embodiments, the two members, i.e., the recoil starter 81 and the cooling fan 38 are covered by the recoil cover 22 by way of example, this configuration is not limitative, but instead, only the cooling fan 38 may be covered by using a dedicated cover of the cooling fan 38.

Although in the first and the second embodiments, the general-purpose engine of liquid-cooling type is a general-purpose engine of water-cooling type by way of example, the coolant may be the other liquid.

The shapes and the configurations of the members depicted in the first and the second embodiments are not limited to the above exemplified ones, but can appropriately be variously changed or modified, the members encompassing the general-purpose liquid-cooled engine 10, the entire engine 12, the engine body 14, the radiator 16, the cover structure 20, 110, the engine cover 21, the recoil cover 22, the muffler cover 23, 112, the communication hole 23*f*, the exterior cover 24, the cooling fan 38, the muffler 61, the cooling air inlet 76, the recoil starter 81 and the louver 92.

The present invention is advantageously applicable to a general-purpose liquid-cooled engine in which a coolant having cooled the engine body is delivered to the radiator together with a cooling air fed to the radiator to cool the coolant.

Obviously, various minor changes and modifications of the present invention are possible in light of the above teaching. It is therefore to be understood that within the scope of the appended claims the invention may be practiced otherwise than as specifically described.

What is claimed is:

1. A cover structure of a general-purpose liquid-cooled engine in which a coolant for cooling an engine body is delivered to a radiator, the radiator being fed with a cooling air by a cooling fan to cool the coolant, the cover structure comprising:

an engine cover configured to cover the engine body and the radiator in such a manner as to allow the cooling air to be delivered to the radiator;

a muffler cover configured to cover a muffler disposed adjacent to an external surface of the engine cover; and an exterior cover configured to cover an entire engine including the engine cover and the muffler cover, wherein the cover structure covers the cooling fan disposed adjacent to the external surface of the engine cover, the cover structure further comprising a recoil cover in which a recoil starter for startup of the engine is incorporated, and wherein the muffler cover comprises:

a communication port disposed so as to allow an interior of the muffler cover to communicate with an interior of the recoil cover; and a louver disposed on the muffler cover to allow a cooling air fed through the communication port into the muffler cover to be discharged to an exterior of the muffler cover.

2. A cover structure of a general-purpose liquid-cooled engine in which a coolant for cooling an engine body is delivered to a radiator, the radiator being fed with a cooling air by a cooling fan to cool the coolant, the cover structure comprising:

an engine cover configured to cover the engine body and the radiator in such a manner as to allow the cooling air to be delivered to the radiator;

a muffler cover configured to cover a muffler disposed adjacent to an external surface of the engine cover; and an exterior cover configured to cover an entire engine including the engine cover and the muffler cover, wherein the cover structure covers the cooling fan disposed adjacent to the external surface of the engine cover, the cover structure further comprising a recoil cover in which a recoil starter for startup of the engine is incorporated, wherein the engine cover has a cooling air inlet for taking in the cooling air thereinto, the cooling air inlet supporting the radiator thereon, wherein the recoil cover communicates with the cooling air inlet, wherein the muffler communicates with an interior of the recoil cover so as to allow the cooling air fed from the cooling fan to be delivered thereinto, and wherein the muffler is disposed on the outside of the engine cover.

3. The cover structure of claim 2, wherein an exhaust gas discharged from the muffler and the cooling air fed from the cooling fan are mixed together in an interior of the muffler cover, and wherein a mixture of the exhaust gas and the cooling air is discharged from the interior of the muffler cover toward an exterior thereof.

* * * * *